United States Patent [19]

Visser

[11] Patent Number: 4,953,381

[45] Date of Patent: Sep. 4, 1990

[54] EXTRUSION PULLER WITH STRIPPER FINGER

[75] Inventor: James T. Visser, Ada, Mich.

[73] Assignee: Granco Clark, Inc, Belding, Mich.

[21] Appl. No.: 438,574

[22] Filed: Nov. 16, 1989

[51] Int. Cl.[5] ..... B21C 35/02

[52] U.S. Cl. ..... 72/257; 72/293; 72/422

[58] Field of Search ..... 72/257, 291, 293, 295, 72/301, 302, 304, 422

[56] References Cited

U.S. PATENT DOCUMENTS

| | | | |
|---|---|---|---|
| 2,298,887 | 10/1942 | Jongedyk | 72/257 |
| 3,107,006 | 10/1963 | Myotte | 72/422 |
| 3,157,268 | 11/1964 | Anderson | 72/257 |
| 3,181,334 | 5/1965 | Mattson et al. | 72/257 |
| 3,210,983 | 10/1965 | Wells | 72/291 |
| 3,881,339 | 5/1975 | Mannell | 72/257 |
| 4,242,895 | 1/1981 | Boshold | 72/257 |
| 4,307,597 | 12/1981 | Elhaus | 72/257 |
| 4,873,857 | 10/1989 | Giancarlo | 72/257 |

*Primary Examiner*—Robert L. Spruill

*Attorney, Agent, or Firm*—Varnum, Riddering, Schmidt & Howlett

[57] ABSTRACT

An extrusion pulling apparatus including an extrusion run-out table and an extrusion puller which is mounted for reciprocal movement along the run-out table. The extrusion puller has an upper jaw mounted for vertical reciprocal movement between clamping and release positions on a support frame and a lower jaw mounted for reciprocal lateral movement between clamping and release positions also on the support frame. The lower jaw is also mounted for vertical movement with respect to the support frame. A stripper finger is mounted on the puller adjacent the upper and lower jaws when the jaws are in the clamping position and is movable laterally to push extrusions toward a cooling table when the lower jaw moves in an opposite direction to strip the extrusions from the lower jaw and to push one end of the extrusions from the extrusion line.

12 Claims, 3 Drawing Sheets

EXTRUSION PULLER WITH STRIPPER FINGER

TECHNICAL FIELD

The invention relates to extrusion pulling apparatus and, more particularly, to an extrusion pulling apparatus having a stripper finger which moves in a direction transverse to the extrusion axis toward cooling and run-out tables to aid the quick removal of the extruded material from the jaws for a decreased cycle time.

BACKGROUND OF THE INVENTION

One of the on-going goals of extrusion operations is to decrease the cycle time for each extrusion operation and thereby increase productivity of the extrusion equipment. Extrusion pulling apparatus incorporate lower jaws which move in a direction transverse to the extrusion axis at the completion of the pulling cycle to allow for removal of the extruded work from the run-out table. The extrusion pulling apparatus then quickly moves back to an initial position to grip a new portion of the work.

Occasionally the extrusions are dragged off the run-out tables by the transverse movement of the jaw from the table. In order to overcome this problem, a fixed stripper finger ha been incorporated in the extrusion pulling apparatus adjacent the jaw to retain the extruded workpiece on the run-out table as the lower jaw is transversely moved. The fixed stripper finger is attached to the extrusion pulling apparatus on the side of the run-out table opposite the cooling table. As the extrusion pulling apparatus completes its pulling cycle, the jaws release their grip on the extruded workpiece and move transverse to the extrusion axis away from the cooling and run-out table. If the extruded workpiece is not completely freed from the lower jaw, the extruded workpiece will ultimately contact the fixed stripper finger as the lower jaw moves in the transverse direction. This contact with the fixed stripper finger and the movement of the jaws causes the workpiece to be removed from the lower jaws and rest on the run-out table for transfer to the cooling table and further operations.

Although the fixed stripper finger effectively retains the extrusions on the run-out table, the extrusions are initially positioned on the far side of the run-out table from the cooling table. It thus takes some time to move the extrusions across the run-out table and onto the cooling table. In the meantime, the extrusions in transit may interfere with the movement of the new extrusions along the run-out tables and thus slow the extrusion cycle.

Strippers have also been used for stripping extruded workpieces from cylindrical mandrels. For example, the U.S. Pat. No. 2,298,887 to Jongedyk (issued Oct. 13, 1942) discloses a pair of stripper members for use in removal of a cylindrical extrusion workpiece from a corresponding cylindrical mandrel in an extrusion press operation. The pair of stripper members interact with each other through an elastic interconnecting linkage means to allow for adjustment of one stripper member relative to the other.

SUMMARY OF THE INVENTION

According to the invention, an extrusion pulling apparatus comprises an extrusion run-out table having a longitudinal axis, a cooling table, an extrusion puller, means mounting said puller for movement along the run-out table, and means on the puller for pushing the work laterally toward the cooling table from the longitudinal axis when the puller reaches a release position along the run-out table. The extrusion puller comprises a support frame, an upper jaw which is movable vertically between clamping and release positions on the support frame and a lower jaw which is movable laterally between clamping and release positions on the support frame. The means for mounting the puller for movement along the run-out table operates between a loading position and a release position to pull the work along a longitudinal axis as the extrusion puller moves between the loading and release positions.

Preferably, the pushing means on the extrusion puller for laterally moving the work comprises a finger mounted adjacent the upper and lower jaws when the jaws are in a clamping position. The pushing means further comprises a guide means mounting the finger above the lower jaw for linear sliding movement of the finger with respect to the support frame. The lower jaw and guide means mounting the finger are both mounted on the support frame.

Support means mount the lower jaw and comprise means for mounting the lower jaw support means to the support frame for vertical movement with respect to the support frame. The previously discussed guide means mounting the finger is mounted to this lower jaw support means. Further, reciprocal means are mounted on the lower jaw support means for reciprocally moving the finger with respect to the lower jaw support means. Means for mounting the lower jaw to the lower jaw support means for lateral movement with respect thereto can also be included. This element comprises means for moving the lower jaw laterally away from the cooling table and means for moving the finger toward the cooling table as the lower jaw is moved away from the cooling table. The finger moving means can include a fluid cylinder.

The invention provides a distinct advantage over the prior art in that it allows for quicker and more efficient operation of the extrusion apparatus. The incorporation of the stripper finger and stripper finger pushing means decreases the cycle time for each extrusion pulling operation by removing the workpiece from the extrusion axis more rapidly. The quicker the workpiece is transferred to the cooling table and removed for further processing, the quicker the extrusion puller can be recycled for further pulling operations.

BRIEF DESCRIPTION OF DRAWINGS

The invention will now be described in detail with reference to the accompanying drawings wherein.

DESCRIPTION OF THE PREFERRED EMBODIMENT

Figure 1:
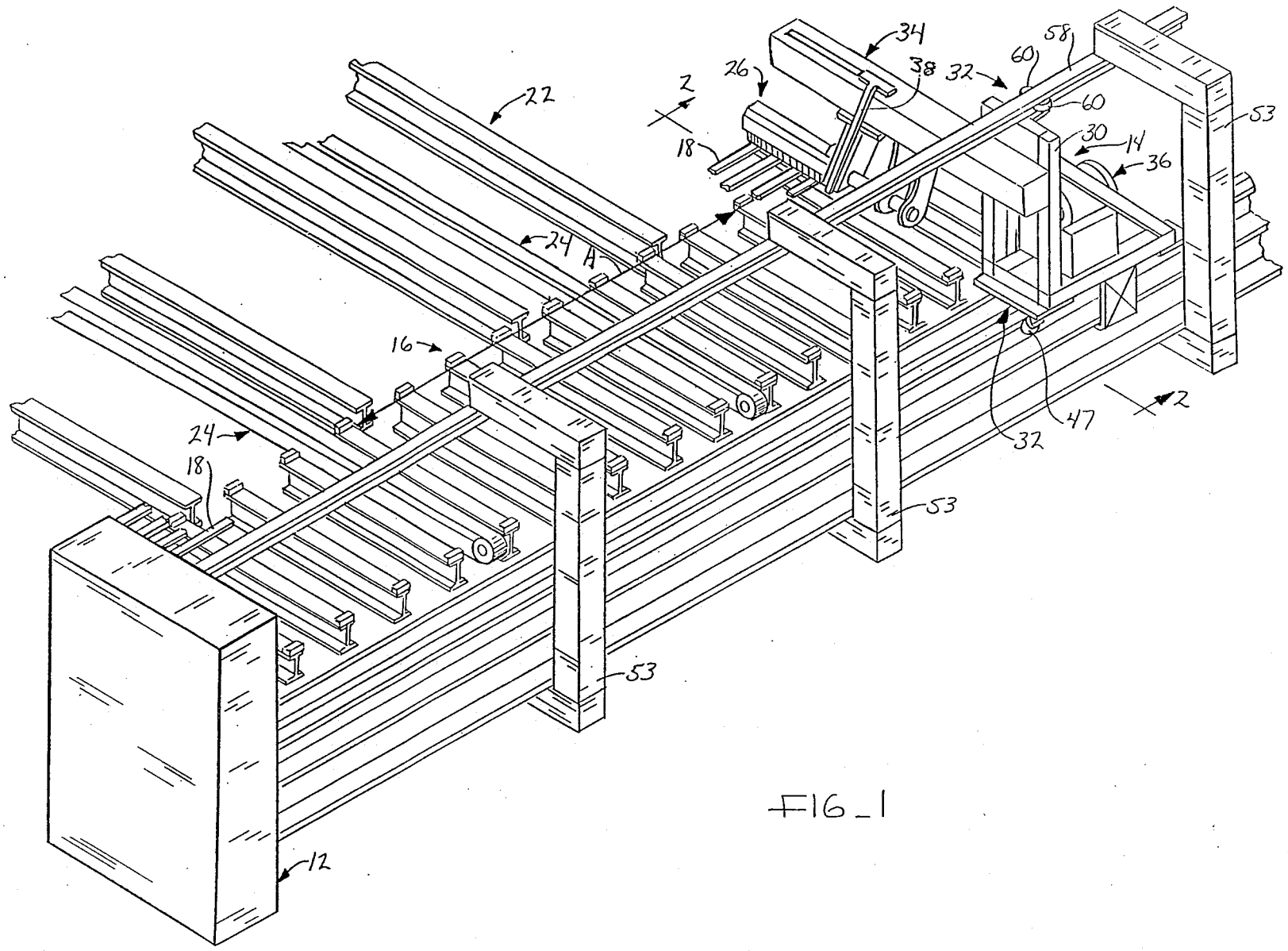
FIG. 1 is a perspective view of an extrusion pulling apparatus incorporating the invention.

Referring to FIG. 1, an extrusion apparatus comprises an extrusion press 12, an extrusion puller 14, a run-out table 16 and a cooling table 22. It is well known to construct a pulling apparatus wherein a material to be pulled 18 (FIG. 3) is forced through the extrusion press 12 and gripped by the extrusion puller 14. The extrusion puller 14 is driven away from the extrusion press 12 along the extrusion axis A which corresponds to the longitudinal axis of the run-out table by a suitable drive means (not shown) and the extruded material 18 is supported by the run-out table 16. After the extrusion is completed, the extruded material 18 is transferred from the run-out table 16 to the cooling table 22 for further processing.

The cycle time for each operation of the extrusion apparatus 10 can be decreased upon the quicker removal of the extruded material 18 from the run-out table 16 onto the cooling table 22. The quicker the workpiece 18 is removed from the run-out table 16, the quicker the extrusion puller 14 can be recycled for another pull. The workpiece 18 is transferred by a conveyor means 24 to the cooling table 22 from the run-out table 16. Conventional conveyor systems for cooling and run-out table assemblies are described in U.S. Pat. No. 4,790,167 to Gentry et al. (issued Dec. 13, 1988) and U.S. Pat. No. 4,507,950 to Elhaus (issued Apr. 2, 1985).

Figure 2:
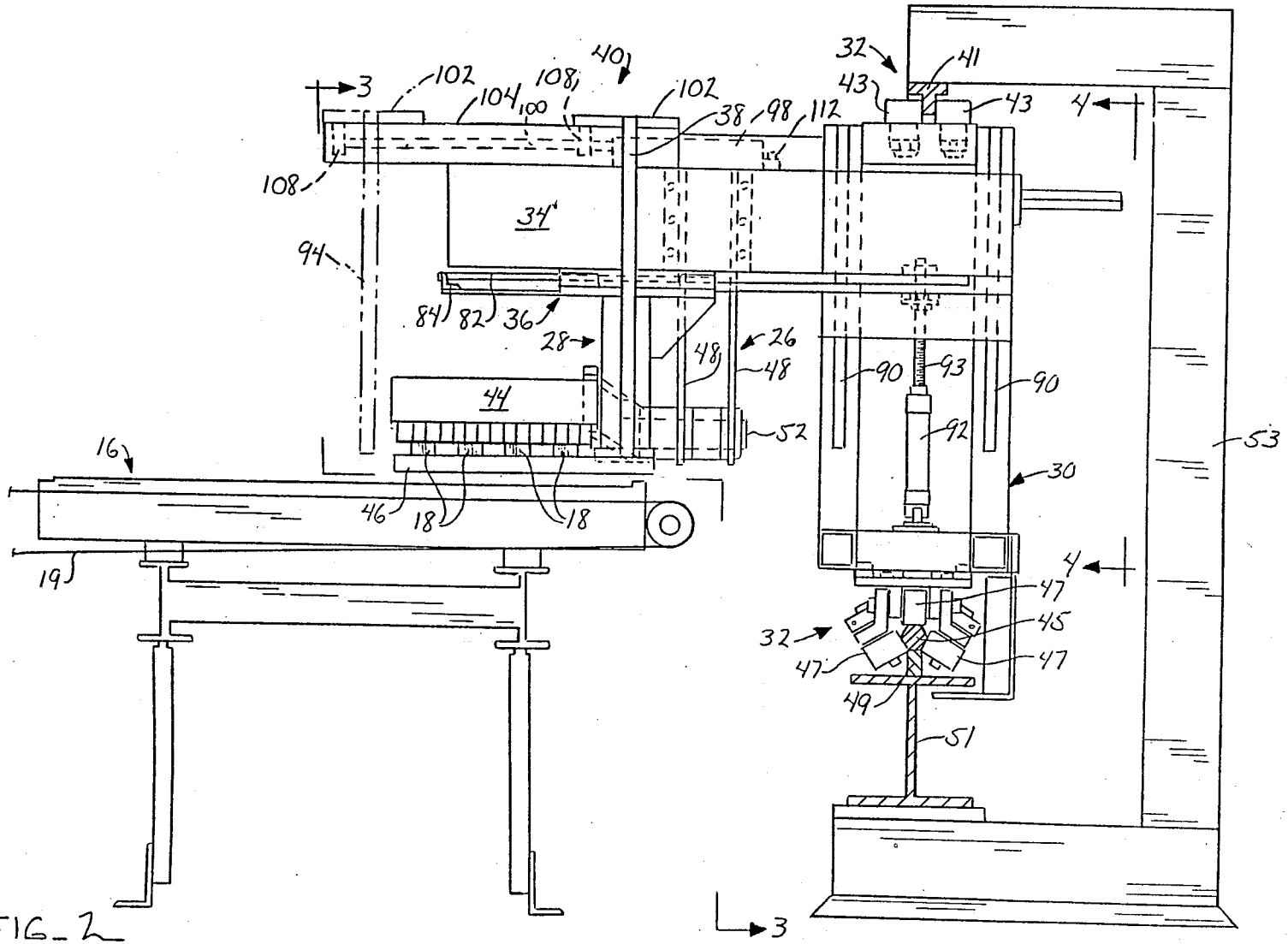
FIG. 2 is a partial sectional end view of the extrusion pulling apparatus shown in FIG. 1 taken along lines 2—2 of FIG. 1.

As seen in FIG. 2, the extrusion puller 14 which is designed to decrease the cycle time for the extrusion operation comprises a rectangular support frame 30, guide means 32, a lower jaw support frame 34, drive means 36 for transverse movement of the puller jaws, upper jaw puller assembly 26, lower jaw puller assembly 28, an upper jaw 44, a lower jaw 46, a stripper finger assembly 38, and guide means for the stripper finger 40.

The rectangular support frame 30 is mounted to the guide means 32 for movement of the extrusion puller 14 along the extrusion axis A. In the preferred embodiment, the guide means 32 comprises a T-shaped guide beam 41, a pair of rollers 43 for the T-shaped guide beam 41, a hexagonal guide beam 45, a plurality of rollers 47 for the hexagonal guide beam 45, a rectangular support beam 49, an I-shaped support beam 51, and a plurality of C-shaped support members 53. The C-shaped support members 53 support both the T-shaped guide beam 41 and the hexagonal guide beam 45. The T-shaped guide beam 41 is fixedly attached to the top portion of the C-shaped support means 53 and the hexagonal guide beam 45 is supported on the lower portion of the C-shaped support member 53 by the rectangular support beam 49 and the I-shaped beam 51. Fixedly attached to the top of the rectangular support frame 30 are the two rollers which are mounted for rolling contact with the T-shaped guide beam 41. These rollers 43 contact the T-shaped guide beam 41 on opposite vertical faces of the T-shaped guide beam 41. The rollers for the hexagonal guide beam 47 are fixedly mounted to the rectangular support frame 30 and roll along the hexagonal guide beam 45 on three of the six surfaces to provide both stability and support for the extrusion puller 14.

Slidably attached (discussed below) to the rectangular support frame 30 for vertical movement with respect thereto is the lower jaw support frame 34. In the preferred embodiment, the lower jaw support frame 34 comprises a rectangular tube which extends horizontally and perpendicular to the extrusion axis A to a point above the run-out table 16. Suspended from the lower jaw support frame 34 is the lower puller jaw assembly 28.

Figure 3:
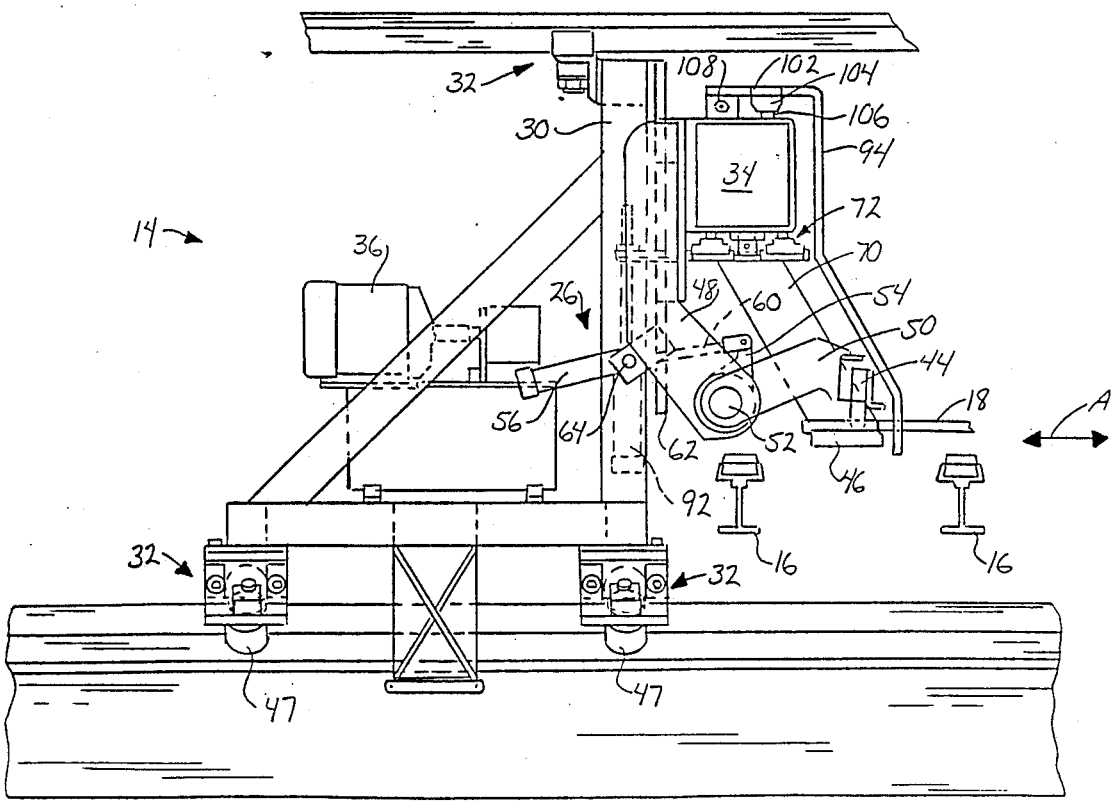
FIG. 3 is a partial sectional view taken along lines 3—3 of FIG. 2.

As seen in FIG. 3, the upper puller jaw assembly 26 comprises the upper puller jaw 44, a fixed upper arm 48, a movable lower arm 50, a pivot pin 52, a crank arm 54, and an upper jaw hydraulic cylinder 56. The upper puller jaw assembly 26 is designed so that the upper puller jaw 44 is pivotably mounted to the lower jaw support frame 34. One end of the fixed upper arm 48 is fixedly attached to the lower jaw support frame 34 and the other end of the fixed upper arm 48 is pivotably connected to the movable lower arm 50 by the pivot pin 52. The fixed upper arm 48 provides support for the movable lower arm 50 during the pulling operation. The upper jaw hydraulic cylinder 56 is pivotably mounted on upper arm 48 through a U-shaped plate 62 and a pivot pin 64. The cylinder 56 has a push rod 60 pivotably attached to the crank arm 54 which is in turn non-rotatably attached to the pivot pin 52. Upon retraction of the push rod 60 of the hydraulic cylinder 56, the movable lower arm 50 and the upper jaw 44 are moved vertically from a clamping to a release position. The upper jaw 44 pivots down to clamp onto the workpiece 18 at the beginning of the extrusion pulling operation and pivots upward to release the gripping pressure on the extruded workpiece 18 upon completion of the pulling cycle.

Figure 4:
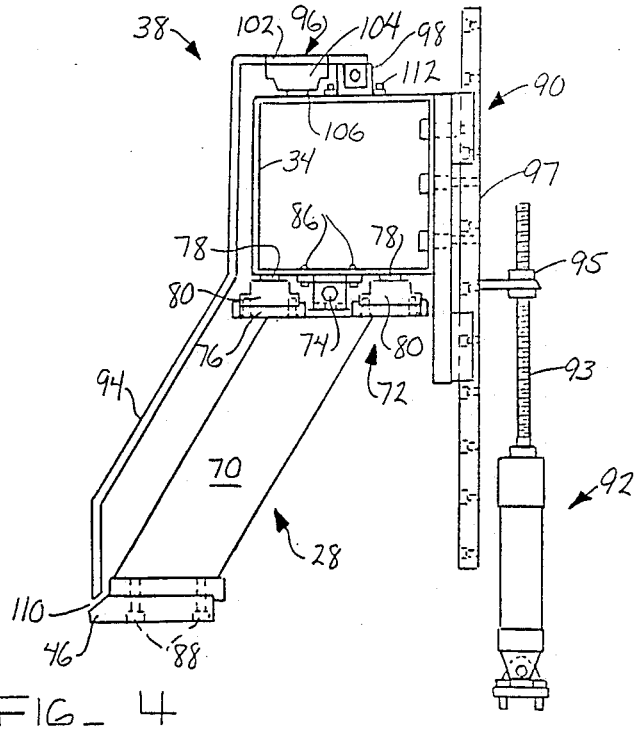
FIG. 4 is a partial sectional view of the lower jaw assembly taken generally along lines 4—4 of FIG. 2.

As seen in FIGS. 3 and 4, the lower jaw assembly 28 is designed to move horizontally in a direction perpendicular to the extrusion axis A to aid in the quick and efficient removal of the workpiece 18 from the extrusion puller 14. The lower jaw assembly 28 comprises a fixed arm 70, a track and bearing assembly 72, a hydraulic cylinder 74 and a push rod 82 (FIG. 2). The track and bearing assembly 72 is mounted on the underside of the lower jaw support frame 34 and comprises an upper track 78 and a lower bearing 80 to facilitate sliding movement of the interlocking tracks. The upper track 78 is fixedly attached to the lower jaw support frame 34 and the lower bearing 80 is fixedly attached to a mounting plate 76 fixed to the top portion of fixed arm 70. Therefore, the mounting plate 76 and lower bearing 80 can slide relative to the lower jaw support frame 34 perpendicular to the extrusion axis A. The track and bearing assembly is preferably the type in which the track 78 has lateral guide flanges which are received in grooves in the bearing 80. Ball or roller bearings are mounted between the guide flanges and the grooves. A suitable bearing structure is a THK LM Guide HSR TYPE manufactured by THK Co. Ltd. of Tokyo, Japan.

The hydraulic cylinder 74 is fixedly attached to the underside of the lower jaw support frame 34 by mounting screws 86. Further, the push rod 82 of the hydraulic cylinder 74 is fixedly attached to the mounting plate 76 by a mounting bracket 84 (FIG. 2). One end of the fixed arm 70 of the lower jaw 46 is also fixedly attached to the mounting plate 76. The other end of the fixed arm 70 is fixedly attached to the lower jaw 46 by a plurality of mounting screws 88 shown in phantom lines in FIG. 4. The fixed arm 70 provides support and stability for the lower jaw 46.

The lower jaw 46 can move in a direction transverse to the extrusion axis A through the operation of the hydraulic cylinder 74 and push rod 82. As the push rod 82 (FIG. 2) is retracted from the hydraulic cylinder 74, the mounting plate 76, fixed arm 70 and lower jaw 46 are moved away from the cooling table 22. As the push rod 82 is extended, the mounting plate and lower jaw assembly are returned to a position above the run-out table 16 as shown in FIG. 2.

Another feature which speeds up the removal of the workpiece 18 from the extrusion axis A and increases the extrusion cycle is the stripper finger assembly 38. As seen in FIG. 4, the stripper finger assembly 38 comprises a stripper finger 94, a track and bearing assembly 96, a hydraulic cylinder 98, a push rod 100 (FIG. 2), and a stripper finger mounting 102. The track and bearing assembly comprises a bearing 104 and a lower track 106 to facilitate sliding motion of the tracks relative to each other. The lower track 106 is fixedly attached to the upper surface of the lower jaw support frame 34. The hydraulic cylinder 98 is also fixedly attached to the upper surface of the lower jaw support frame 34 by mounting screws 112. The stripper finger mounting 102 is fixedly attached to the bearing 104, the push rod mounting 108 (FIG. 2), and the stripper finger 94. The stripper finger 94 extends downward to a point adjacent to the leading edges of the upper and lower jaws 110 while in the clamped position. The track and bearing assembly 96 is of the same nature as the track and bearing assembly 72.

During the pulling operation, the stripper finger 94 is in the retracted state, shown in solid lines in FIG. 2, and the jaws are above the run-out table 16 as seen in FIG. 2. At the completion of the pulling cycle, the upper jaw 44 pivots upward to release the gripping pressure on the workpiece 18. Thereafter, the stripper finger 94 and lower jaw assembly 28 work in conjunction to quickly remove the workpiece 18 from the run-out table 16 to allow for a quick return of the extrusion puller 14. The hydraulic cylinder 98 of the stripper finger 98 begins to extend the push rod 104, thereby forcing the stripper finger 94 in a direction toward the cooling table 22, i.e., to the left as seen in FIG. 2. At the same time, the hydraulic cylinder of the lower jaw 74 begins to retract the push rod 82, thereby forcing the lower jaw assembly in a direction opposite the movement of the stripper finger 94, away from the cooling table 22. Through the opposite motion of these two assemblies, the stripper finger 94 can quickly contact the workpiece 18, push it away from the extrusion axis, thereby removing it from the lower jaw 46 and transferring the workpiece 18 to the cooling portion of the run-out table 16.

As seen in FIGS. 2 and 4 the lower jaw support frame 34 is slidably mounted on the rectangular support frame 30 so that the support frame 30 and lower jaw apparatus 28 can move vertically relative to the run-out table 16. This movement is accomplished by a sliding track assembly 90 and hydraulic cylinder assembly 92. The hydraulic cylinder assembly 92 is mounted at a lower portion to the support frame 30 and has an extendible push rod 93 in the form of a threaded rod which is secured through nuts 95 to the sliding track 97 which, in turn, is mounted to the lower jaw support frame 34. The sliding track assembly 90 allows for sliding movement of the lower jaw support frame 34 vertically along the rectangular support frame 30. This sliding movement is accomplished by the extension and retraction of the push rod 93 of hydraulic cylinder assembly 92.

The vertical movement of the lower jaw assembly 28, which is accomplished by the track and bearing assembly 90 of the rectangular support frame 30 and the hydraulic cylinder 92 of the rectangular support frame 30, is necessary for the proper loading of the workpiece 18 in the upper and lower jaws 44 and 46. As the workpiece exits the extrusion press 12, the lower jaw assembly 28 moves vertically upward from its release state to its clamping state. The puller 14 then accelerates along the extrusion line so that the puller 14 and the extrusion 18 move at the same speed. The upper jaw assembly 26 then moves downward from its release state to the clamping state to grip the workpiece 18 between the upper and lower jaws 44 and 46. After sufficient clamping pressure has been exerted, the extrusion puller 14 begins the pulling operation from the force supplied by the extrusion puller drive means (not shown).

The coordinated clamping motion of the upper jaw apparatus 26 and the lower jaw apparatus 28 is also suitable for receiving the workpiece 18 from another extrusion puller (not shown). Two pullers may work together on the same run-out table to increase the productivity of the equipment as follows: A first puller P-1 receives the workpiece from the extrusion press as described above. Then, the puller P-1 pulls the workpiece 18 to a point midway on the extrusion axis A and transfers the workpiece 18 to a second puller P-2 which continues the pulling operation for the desired length of the work. As the second puller P-2 is completing the extrusion operation, the first puller P-1 can recycle back to the loading position near the extrusion press 12. When the first puller P-1 returns to the extrusion press, it awaits the die line and then grips the extrusion. It will cut off the extrusion after it grips the same. The cut-off operation is timed to correspond to the puller P-2 reaching the end of its travel in the pulling cycle. The transfer from one puller to the other is accomplished as follows: as the first puller P-1 nears the midway point of the extrusion axis A-A, the second puller P-2 is aligned behind the first puller P-1. The P-2 upper jaw assembly 26 moves downward into the clamping position while the lower jaw assembly 28 moves vertically upward to the clamping position to grip the workpiece 18 at a point behind the first puller P-1. When sufficient gripping pressure is applied, the upper and lower jaws 44, 46 of the first puller P-1 release their grip and the first puller P-1 may be recycled while the second puller P-2 continues the pulling operation.

While particular embodiments of the invention have been shown, it will be understood, of course, that the invention is not limited thereto since modifications may be made by those skilled in the art, particularly in light of the foregoing teachings. It is, therefore, contemplated by the appended claims to cover any such modification as incorporate those features which constitute the essential features of these improvements within the true spirit and scope of the invention.

I claim:

1. An extrusion pulling apparatus comprising:

an extrusion run-out table, having a longitudinal axis and a cooling table adjacent to the longitudinal axis;

an extrusion puller having a support frame, an upper jaw which is mounted for reciprocal vertical movement between clamping and release positions on the support frame, and a lower jaw which is mounted for reciprocal lateral movement between clamping and release positions on the support frame;

means mounting said puller for movement along the run-out table between a loading position and a release position to pull the work along the longitudinal axis as the extrusion puller moves between the loading and release positions;

the improvement which comprises:

means on the extrusion puller for pushing the work laterally toward the cooling table and from the longitudinal axis when the puller reaches the release position along the run-out table.

2. An extrusion pulling apparatus according to claim 1, wherein said pushing means comprises a finger mounted adjacent the upper and lower jaws when said jaws are in a clamping position.

3. An extrusion pulling apparatus according to claim 2 wherein said pushing means further comprises a guide means mounting the finger above the lower jaw for linear sliding movement of the finger with respect to the support frame.

4. An extrusion pulling apparatus according to claim 3 wherein said lower jaw is mounted on the support frame and the guide means mounting the finger is mounted to the support frame.

5. An extrusion pulling apparatus according to claim 4 and further comprising support means mounting the lower jaw; means for mounting the lower jaw support means to the support frame for reciprocal vertical movement with respect to the support frame; and the guide means mounting the finger is mounted to the lower jaw support means.

6. An extrusion pulling apparatus according to claim 5 and further comprising means for reciprocally mounting the finger to the lower jaw support means for reciprocal movement of the finger with respect to the lower jaw support means.

7. An extrusion pulling apparatus according to claim 6 and further comprising means for mounting the lower jaw to the lower jaw support means for lateral movement with respect thereto and means for moving the finger toward the cooling table as the lower jaw is moved away from the cooling table.

8. An extrusion pulling apparatus according to claim 7 wherein the finger moving means includes a fluid cylinder.

9. An extrusion pulling apparatus according to claim 1 and further comprising lateral conveyor means associated with the run-out table for moving the work from the longitudinal axis to the cooling table.

10. An extrusion pulling apparatus according to claim 1 and further comprising means for reciprocally mounting the finger to the lower jaw support means for reciprocally moving the finger with respect to the lower jaw support means.

11. An extrusion pulling apparatus according to claim 10 and further comprising means for mounting the lower jaw to the lower jaw support means for lateral movement with respect thereto and means for moving the finger toward the cooling table as the lower jaw is moved away from the cooling table.

12. An extrusion pulling apparatus according to claim 11 wherein the finger moving means includes a fluid cylinder.

* * * * *